United States Patent [19]

Wirz

[11] Patent Number: 4,589,392

[45] Date of Patent: May 20, 1986

[54] ELECTRONIC CONTROL SYSTEM FOR FUEL INJECTION OF A DIESEL ENGINE

[75] Inventor: Josef Wirz, Stuttgart, Fed. Rep. of Germany

[73] Assignee: Robert Bosch GmbH, Stuttgart, Fed. Rep. of Germany

[21] Appl. No.: 692,927

[22] Filed: Jan. 17, 1985

[30] Foreign Application Priority Data

Feb. 16, 1984 [DE] Fed. Rep. of Germany ..... 3405495

[51] Int. Cl.[4] ..... F02M 59/00

[52] U.S. Cl. ..... 123/357; 123/359

[58] Field of Search ..... 123/357, 358, 359, 479, 123/198 D

[56] References Cited

U.S. PATENT DOCUMENTS 4,174,694 11/1979 Wessel et al. ..... 123/357
4,370,962 2/1983 Hosaka ..... 123/479
4,423,713 1/1984 Sami et al. ..... 123/357
4,425,889 1/1984 Hachitani et al. ..... 123/357
4,459,955 7/1984 Adey et al. ..... 123/357

FOREIGN PATENT DOCUMENTS 88426 5/1983 Japan ..... 123/357

*Primary Examiner*—Magdalen Y. C. Moy
*Attorney, Agent, or Firm*—Michael J. Striker

[57] ABSTRACT

An electronic control system for fuel injection of a diesel engine includes a field of characteristics for a smoke discharge limiter which is controlled either by a field of correction characteristics of charging air pressure in dependency on signals derived from sensors of operational parameters of the engine, or alternatively by a simulation unit operating without the use of sensors. The decision whether or not the control and/or regulation of the diesel engine is to be made in dependency on sensors is made by an evaluation circuit which evaluates operational condition of the engine, for example by means of a plausibility interrogation.

5 Claims, 1 Drawing Figure

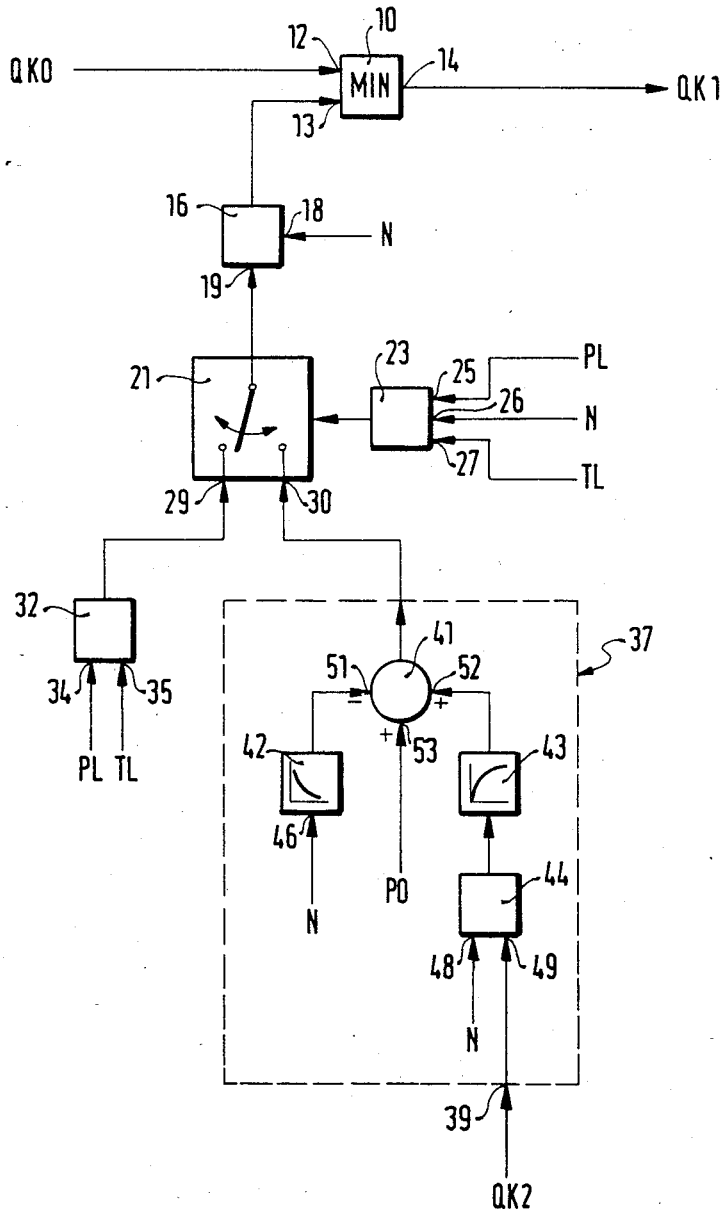
QKO
MIN
QK1
10
12
13
14
16
18
N
19
21
23
25
26
27
PL
N
TL
29
30
32
34
35
PL TL
37
41
51
52
42
43
53
46
N
PO
44
48
49
N
39
QK2

ELECTRONIC CONTROL SYSTEM FOR FUEL INJECTION OF A DIESEL ENGINE

BACKGROUND OF THE INVENTION

The present invention relates in general to electronic control systems for fuel injection of a diesel engine, the system including sensors for detecting operational variables which determine operational condition of the engine, a set of characteristics for a smoke discharge limiter, means for interpreting the set of characteristics in dependency at least on rotary speed of the engine to produce a signal indicative of mass of fuel supplied to the engine, means for generating in dependency on rotary speed a simulation signal indicative of air mass supplied to the engine, and means for evaluating the sensed operational variables to determine operative condition of the engine.

It is known from prior art to detect by means of sensors in a charged diesel engine the charging air temperature and charging air pressure and to apply the detected values for controlling the quantity of fuel supplied to the engine. Known is also from German Patent application No. P 32 04 804.1 a smoke discharge limiter which in order to determine operational variables of the engine does not need any sensors. In using the two mode operations in connection with a charged diesel engine, however, it is not possible to guarantee a satisfactory operation of each system, for example, in the case of the failure of the sensor for charging air pressure.

SUMMARY OF THE INVENTION

It is therefore a general object of the present invention to overcome the aforementioned disadvantage.

More particularly, it is an object of the invention to provide an improved electronic control system of the aforedescribed kind which guarantees that during all operational conditions of a charged diesel engine an optimum smoke discharge limitation is obtained.

In keeping with this object and others which will become apparent hereafter, one feature of the invention resides in a combination which comprises a set of correction characteristics for loading air pressure which in cooperation with the set of characteristics for the smoke discharge limiter determines the quantity of fuel to be supplied in the engine, and by means of an evaluation device for operational variables of the engine a malfunction of the latter is detected, and in the case of an occurrance of such a malfunction the field of correction characteristics for loading air pressure is replaced by a simulation signal which affects the set of characteristics for the smoke discharge limiter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE illustrates in a schematic block circuit diagram the basic construction of an electronic control system for fuel injection means of a diesel engine.

DESCRIPTION OF THE PREFERRED EMBODIMENT

In the illustrated exemplary embodiment, the electronic control system is designed for affecting the metering of fuel in a charged internal combustion engine operating with self-ignition.

In particular, the illustrated control system is applicable for fuel injection control in a diesel engine. Reference numeral 10 indicates a minimum value selector for fuel metering. The minimum value selector has inputs 12 and 13 and an output 14. A signal QKO corresponding to mass of fuel is fed to input 12. A signal from the output of a set or field of characteristics 16 of a smoke discharge limiter is applied to the input 13. Signal QK1 at the output 14 of the selector 10 affects the fuel metering in a fuel injection device of the engine. The field of characteristics 16 of the smoke discharge limiter has an input 18 to which a signal N indicative of the rotary speed of the engine, is applied. Another input 19 of the field of characteristics 16 is connected to an output of a switch 21 whose switching condition is controlled by the output of an evaluation circuit 23. The evaluation circuit has inputs 25, 26 and 27 supplied respectively with a signal PL corresponding to charging air pressure, with the signal N corresponding to the rotary speed of the engine and with a signal TL corresponding to charging air temperature. The switch 21 has two inputs 29 and 30. The input 29 is connected to the output of a field of correction characteristics 32 for loading air pressure. The field of correction characteristics 32 has two inputs 34 and 35 connected respectively to a source of a signal PL corresponding to the loading air pressure, and to a signal TL corresponding to the loading air temperature. If desired, the field of correction characteristics 32 for loading air pressure can be provided with additional inputs, for instance for the rotary speed signal N. The other input 30 of the switch 21 is connected to the output of a simulation unit 37. The simulation unit 37 consists of a subtractor 41 whose output is connected to the input 30 of the switch 21 and whose input 51 is connected to the output of a differentiator with delay 42; another input 52 of subtractor 41 is connected via a delay circuit 43 to the output of a set of field of characteristics 44 for a stationary charge. The input 46 of the differentiator with delay 42 is supplied with the rotary speed signal N. One input 48 of the field of characteristics 44 is also supplied with rotary speed signal N and the other input 49 of the field of characteristics 44 is supplied with a control signal QK2. A third input 53 of the subtractor 41 is connected to a source of signal PO which represents a fixed, preset value of the charging air pressure, or a function of the measured atmospheric pressure. The output signal of the subtractor 41 corresponds to the output of the simulation unit 37 and is connected to the input 30 of the switch 21.

Signal QKO applied to the input 12 of the minimum value selector 10 corresponds to a mass of fuel supplied to the engine and also affects the fuel metering in the fuel injection system of the engine. The signal QKO becomes effective exactly at the moment when its value drops below the value of the signal at the input 13 of the selector 10. The fuel mass signal QKO depends for example on the position of gas pedal, on the idling speed regulation, on the starting process regulation and the like. The signals QK1 and QK2 also relate to fuel mass and also affect the fuel metering in the fuel injection means of the engine. It is of importance that only the signal QK1 continuously influences the fuel metering of the engine whereas the signal QK2 affects the fuel metering in the case only when the switch 21 is switched over.

In normal operation of the pressure charged diesel engine, the switch 21 connects the field of correction characteristics 32 for loading air pressure with the field of characteristics 16 for smoke discharge limiter. Provided that the value of signal QKO at the input 12 of the selector 10 is greater than the value of the signal at the input 13, a signal QK1 is generated at the output 14 of the selector 10 which influences the fuel metering. Hence, the signal QK1 is generated at least in response to the loading air pressure and to the loading air temperature applied to the field of correction characteristics 32. During the normal operational condition of the diesel engine an exact control and regulation of the fuel injection of the latter is made possible due to the fact that through the signals PL and TL important operational variables of the pressure charged diesel engine are utilized for the control.

A malfunction, for example of the sensor of charging air pressure, is recognized by the evaluational circuit 23 by means of one or more plausibility interrogations. In the event of such a malfunction the switch 21 is activated and switched over to a position in which the field of correction characteristic 32 for charging air pressure is disconnected from the field of characteristics 16 for the smoke discharge limiter and connected to the simulation unit 37. In addition, the evaluation circuit 23 can directly or indirectly affects the charger of the diesel engine. Since in the case of a malfunction only the simulation unit 37 is connected to the input of the field of characteristic values 16 for the smoke discharge limiter, the signals PL and/or TL which may be erroneous have no longer any influence on the control and regulation of the diesel engine.

The simulation unit 37 is independent on the signals PL and TL. It generates at its output a signal from the sum of signals PO which as mentioned before, correspond to a fixed preset or measured value of the charging air pressure, of the differentiated and delayed rotary speed signal (that is rotary speed change) and of a signal produced by correcting and delaying the fuel mass signal QK2. The correction of the signal QK2 is made by means of the stationary field of characteristics 44 corresponding to stationary charging, and in dependency on the rotary speed signal N. The time delay of the corrected signal is performed by the delay circuit 43. A more detailed operation of the simulation unit 37 is disclosed in the beforementioned German patent application No. P 32 04 804.1.

It is now possible that the signal QK2 corresponds to a desired value of fuel mass. The desired value of fuel mass can be also corrected by means of a field of characteristics pertaining to the pump and in dependency on rotary speed, for example. The signal QK2 is then applied to a setting regulator for the regulating rod of the diesel engine. It is also possible that the signal QK1 corresponds to the desired value of the fuel mass. The control of this invention however is not limited to the specific value of the desired fuel mass but for the signals QK1 and QK2 there can be used also other values of the fuel mass which may occur during the control and regulation of the diesel engine.

It will be understood that each of the elements described above, or two or more together, may also find a useful application in other types of constructions differing from the types described above.

While the invention has been illustrated and described as embodied in an electronic control system for fuel injection of a diesel engine, it is not intended to be limited to the specific example, since various modifications and structural changes may be made without departing in any way from the spirit of the present invention so as to employ the control system generally in other types of internal combustion engine. It is not intended also to limit the invention to analog circuits inasmuch by means of a corresponding program the control can be performed by means of a microprocessor. In the digitalized modification it is also of importance that the basic idea of this invention, namely to utilize for the control and/or regulation of the fuel injection a circuit which is dependent on the operational condition of the engine and can operate either in response to the output of sensors or without such sensors.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended c1aims:

1. An electronic control system for fuel injection in an internal combustion engine, comprising means for sensing operational variables of the engine, a field of characteristics for a smoke discharge limiter, means for interpreting the field of characteristics for the smoke discharge limiter in dependency at least on rotary speed of the engine to produce a signal indicative of mass of supplied fuel, means for generating in dependency on rotary speed and at least one preset additional value a simulation signal indicative of air mass supplied to the engine, means for evaluating the sensed operational variables to detect a correct or an incorrect operational condition of the engine, and controlling means cooperating with the simulation signal generating means and with the evaluating means to adjust the field of characteristics of the smoke discharge limiter in dependency on the supplied amount of air and on momentary operational condition of the engine.

2. An electronic control system for fuel injection in an internal combustion engine, comprising means for sensing operational variables of the engine, a field of characteristics for a smoke discharge limiter, means for interpreting the field of characteristics for the smoke discharge limiter in dependency at least on rotary speed of the engine to produce a signal indicative of mass of supplied fuel, means for generating in dependency on rotary speed a simulation signal indicative of air mass supplied to the engine, means for evaluating the sensed operational variables to detect a correct or an incorrect operational condition of the engine, and controlling means cooperating with the simulation signal generating means and with the evaluating means to adjust the field of characteristics of the smoke discharge limiter in dependency on the supplied amount of air and on momentary operational condition of the engine, and wherein said simulation signal generating means generates the simulation signal in dependency on an additional regulation signal indicative of the fuel mass.

3. An electronic control system as defined in claim 2, wherein the additional regulation signal corresponds to fuel mass supplied to the internal combustion engine.

4. An electronic control system as defined in claim 1, wherein the field of characteristics for the smoke discharge limiter controls either directly or indirectly fuel metering in the injection means of the engine.

5. An electronic control system for fuel injection in an internal combustion engine, comprising means for sensing operational variables of the engine, comprising means for sensing operational variables of the engine, a field of characteristics for a smoke discharge limiter, means for interpreting the field of characteristics for the smoke discharge limiter in dependency at least on rotary speed of the engine to produce a signal indicative of mass of supplied fuel, means for generating in dependency on rotary speed a simulation signal indicative of air mass supplied to the engine, means for evaluating the sensed operational variables to detect a correct or an incorrect operational condition of the engine, and controlling means cooperating with the simulation signal generating means and with the evaluating means to adjust the field of characteristics of the smoke discharge limiter in dependency on the supplied amount of air and on momentary operational condition of the engine, and wherein said simulation signal generating means includes a subtractor having an output and a plurality of inputs, the output of the subtractor corresponding to the output of the simulation means, one of the inputs of the subtractor being connected via a differentiator with a delay to a source of rotary speed signal, another input being connected via a delay circuit and a field of characteristics for a fixed, preset or measured value of loading air pressure, to a source of a fuel mass signal derived from the regulation of the internal combustion engine.

* * * * *